United States Patent [19]

Payha

[11] Patent Number: 4,741,871

[45] Date of Patent: May 3, 1988

[54] FREE FLOW HUMIDIFIER

[76] Inventor: Richard E. Payha, 881 N. East Dr., North Huntingdon, Pa. 15642

[21] Appl. No.: 28,465

[22] Filed: Mar. 20, 1987

[51] Int. Cl.[4] ..... B01F 3/04

[52] U.S. Cl. ..... 261/153; 261/119.1; 261/DIG. 15; 126/113

[58] Field of Search ..... 261/DIG. 15, 119.1, 261/153; 126/113

[56] References Cited

U.S. PATENT DOCUMENTS

| | | | |
|---|---|---|---|
| 2,730,340 | 1/1956 | Patriarca | 261/26 |
| 2,820,448 | 1/1958 | Hansen | 126/113 |
| 2,993,107 | 7/1961 | Fichtner | 261/DIG. 15 |
| 3,305,173 | 2/1967 | Beckman | 126/113 |
| 3,323,784 | 6/1967 | Fazio | 261/130 |
| 3,355,155 | 11/1967 | Heltsen et al. | 126/113 |
| 3,497,187 | 2/1970 | Skerritt | 261/DIG. 15 |
| 3,801,077 | 4/1974 | Pearson | 261/DIG. 15 |
| 3,824,985 | 7/1974 | Hetherington | 261/DIG. 15 |
| 3,869,529 | 3/1975 | Follette | 261/130 |

*Primary Examiner*—Tim Miles

[57] ABSTRACT

A humidifier is described for use in combination with a hot air forced heating system. The humidifier consists of a main housing (water box) which maintains a constant water level from a existing water source sand controlled by a float control valve. The water is heated by a hot water heating coil. Hot air is directed into, through, and back into the main hot air stream. During this process, the hot dry air picks up moisture, becoming saturated, which is returned and mixed in the hot air supply duct, providing humidity throughout the entire system. The amount of air and humidity can be controlled by the inlet dampers, which regulates the amount of air flowing through the humidifier.

1 Claim, 3 Drawing Sheets

INSTALLATION SCHEMATIC

FREE FLOW HUMIDIFIER

BACKGROUND OF THE INVENTION

The present invention relates to providing improvements in humidifiers, which are mainly used to provide humidity control in forced hot air heating systems during winter operation.

Why does indoor air become dry?

Cold air can't hold much moisture.

Warm air can hold quite a lot of moisture

When heated, cold moist air becomes warm, very dry air and this is caused by infiltration and repeated heating of air during the winter season.

There are three basic reasons for providing such humidity control.

1. To provide and maintain a feeling of warmth and a health benefit by keeping the throat and nasal passages from drying out and eliminating the feeling of cold even when temperatures reach 70° to 75° F. These problems and feelings are caused by hot air containing very little moisture.

2. With materials like nylon, plastics, and some fabrics, there is a potential of storing and generating static electricity, though only annoying to humans and pets, it is very dangerous if there is a possibility of fire or explosion. The only way to eliminate the above problem is by maintaining a high relative humidity.

3. The third reason for maintaining humidity control is to preserve moisture contents of hygroscopic materials. Materials like wood, paper, leather, plaster, and many other household materials can be seriously effected by the lack of moisture, by shrinking, peeling and cracking.

DESCRIPTION OF THE PRIOR ACT

As indicated above, the basic problem is getting and maintaining enough water, in the form of water vapor, in a hot air heating system, to maintain a relative humidity of about 45% to 60%. The present humidifiers have, in the past, been built in a wide variety of types and materials of construction. As to types, open evaporator pan, wick, wheel, water spray, steam and most of the units above required electric or a fuel gas to operate. As to materials of construction, the above units contain metals, copper, brass, sponge rubber, felt, and also revolving parts, both electrical and mechanical.

Due to the actions and interactions caused by many chemicals, solids, and dissolved solids (which are found in today's water and well water supplies), a severe corrosion and coating occurs from the contact of the above parts and materials and hot or cold air with hot or cold water, from repeated wetting and drying effects. A rigorous schedule of inspection, cleaning and replacement of parts must be kept to insure a clean, safe and efficient humidifier can be kept in operation.

SUMMARY OF INVENTION

This invention relates to providing an automatic, improved humidifier to provide water vapor to maintain the required humidity level in heated areas.

Object of invention:

1. To provide an efficient, effective, safe, and inexpensive humidifier having minimum operation cost, low replacement operation costs due to few moving parts and no power or fuel gas required.

2. To provide humidified air that is cleaner and healthier by the elimination of many moving and metal parts that can corode and rust which can cause airborne particles that can be transmitted through the hot forced air heating system.

3. To provide an improved humidifier that requires little or no maintenance.

4. To provide an improved humidifier that can be installed on the hot air outlet duct of a forced air heating system.

The above requirements are attained by the invention, which consists of a main housing, air inlet and outlet elbows, a control damper and a heating coil to heat the cold water. This heated water is used to increase and maintain humidity levels as required.

The humidifer is mounted on the outside of the discharge duct of a forced hot air furnace, by mounting on the hot air outlet the housing can be much smaller due to the fact that hot air will pick up and retain much more moisture than cold air or also if the cold air is reheated much of its moisture is lost. The humidifier also can be visually inspected and repaired very easily due to the external mounting arrangement.

Due to the basic design, all plastic construction and only two moving mechanical parts (1) air flow control damper, which contacts the hot air only and (2) float valve, which contacts the hot water. The initial cost is low and replacement parts costs are also very low. The life of the humidifier is excellent because of little or no effects of corrosion or rust from the hot water and hot air.

Other advantages of the invention are, the use of a standard plastic float water control valve to supply and maintain water to the unit. The invention also has an overflow and being mounted on the outside of the hot air duct can't do any damage to the heating furnace in the remote event of the float sticking open and causing water to overflow the main housing.

The present design of the invention is to make the operation, inspection and cleaning of the unit as simple and safe as possible.

The above objects and advantages of the invention will be apparent from reading the following description of the disclosure found in the accompanying drawings and the novelty thereof pointed out in the claims.

DESCRIPTION OF A PREFERRED EMBODIMENT

Figure 1:
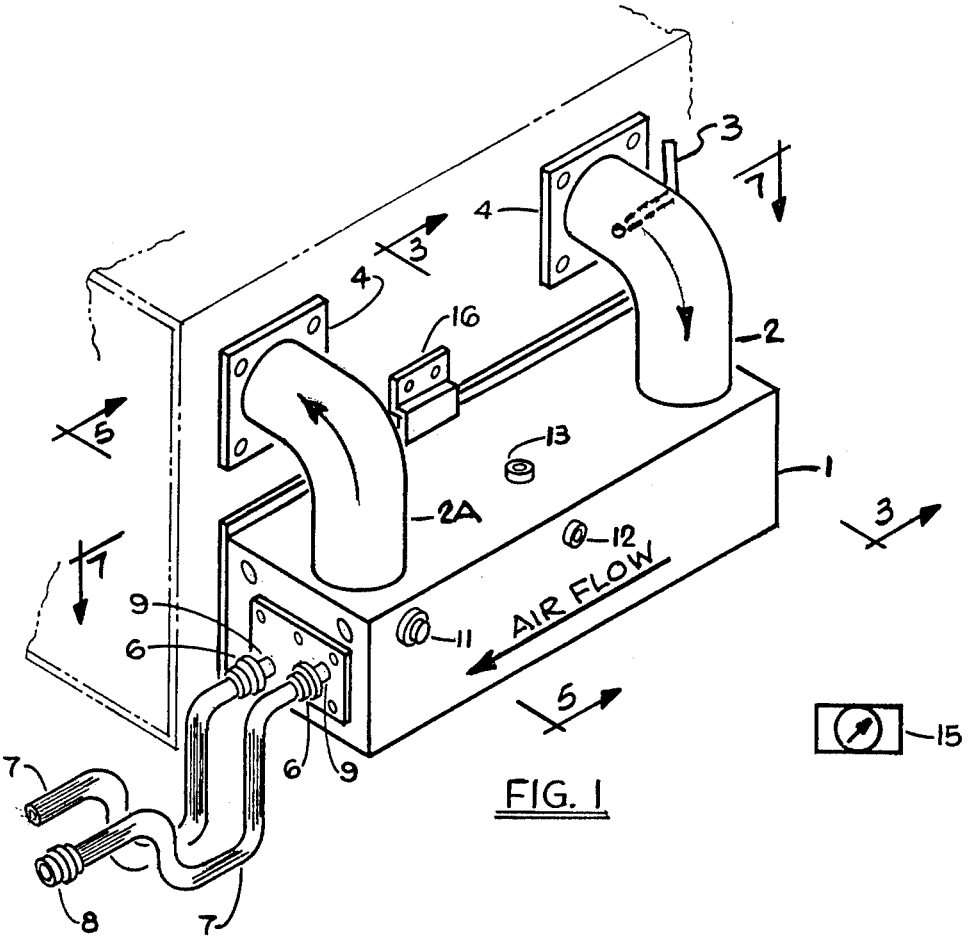
FIG. 1 Is a perspective view of a hot air furnace discharge duct on which a humidifer embodying the present invention, has been installed.

FIG. 1 illustrates a perspective view of the humidifier 1 mounted on the discharge air duct 20 of a forced hot air heating furnace. Most common forced air heating systems consist of a cold air return duct, filters, blower, firebox/heat exchanger and hot air discharge duct. The furnace is controlled by a thermostat and the blower is actuated by a temperature switch, high on, low off.

The humidifier 1 (see also FIG. 2 installation schematic) is supplied with hot water from the existing hot water system. The humidifier consists of four basic components humidifier (water box) 1, inlet heating coil 9, elbows 2 and 2A and damper 3. The water box 1 is supplied with hot water from the existing hot water source. This hot water supply is a gravity loop system that feeds the water float control valve 11, this float control valve maintains a water level in the water box 1 and is evaporated into the hot air stream that is diverted into and through water box 1 by elbow 2 and 2A. The same hot water supply feeds the hot water heating coil 9 and then returns through hose 7 to the hot water tank. The amount of hot air that can be diverted through the water box 1, which becomes 100% saturated then remixed back into the main hot air stream to supply humidified hot air to the entire house or area requiring humidification is controlled by the following: The present (percent) humidity level indicated on a remote humidity gauge 15 (FIG. 1), located in the humidified area, would be used to preset and adjust the flow control damper 3 (FIGS. 3-4) to obtain the correct humidity levels required throughout the home or area.

Figure 2:
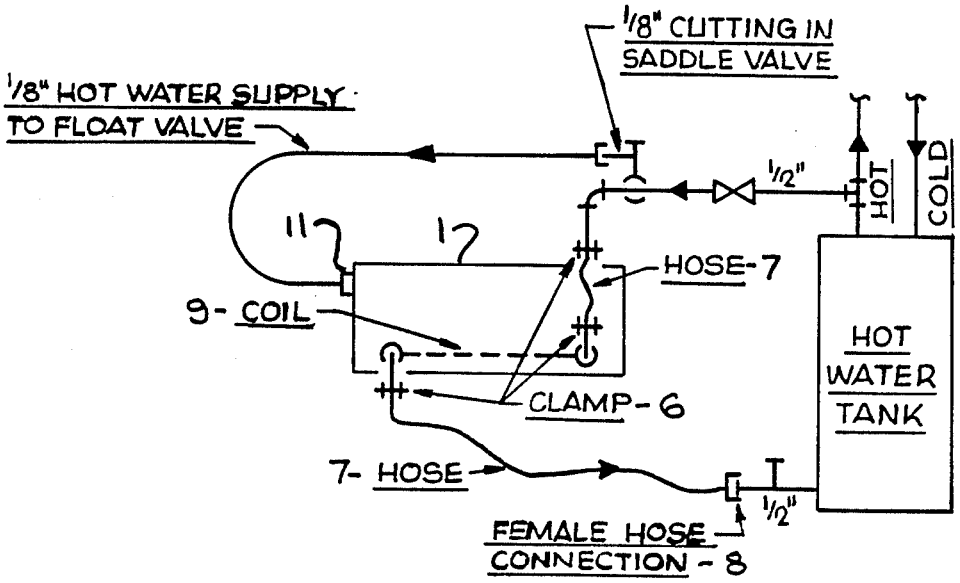
FIG. 2 Installation schematic for the humidifer.

Miscellaneous parts and items indicated in FIG. 1 and FIG. 2 are, elbow mounting plates 4, hot water supply return hoses and fittings 6, 7, 8, overflow connection 12, water freshener or conditioner fill connection 13 (this port 13 can be used to add any type commercial freshener or conditioner, due to different types of water in various area), also shown is a top mounting clip 16.

Figure 3:
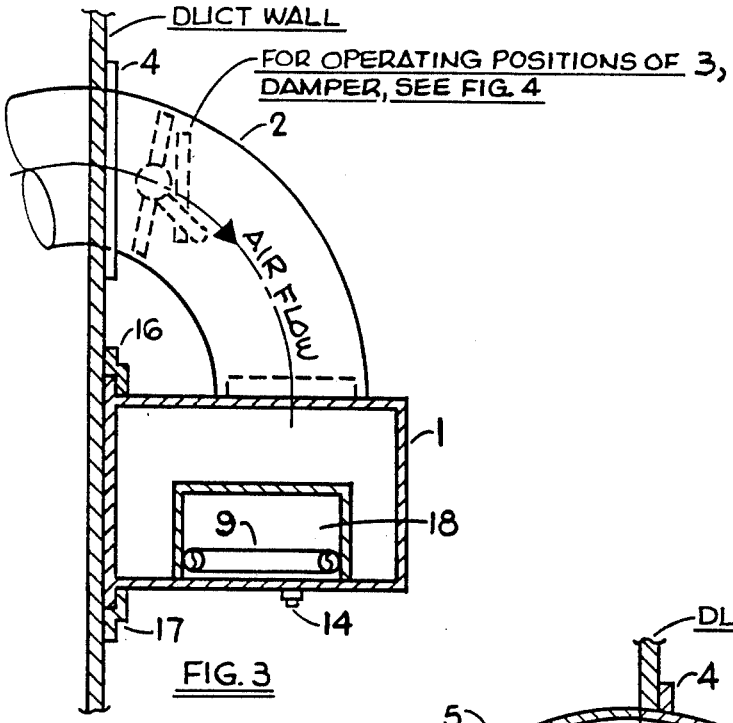
FIG. 3 Is a section taken on line 3—3 in FIG. 1.

FIG. 3 is a sectional view of the water box 1 and inlet hot air elbow 2, showing mounting details elbow plate 4, mounting clips 16 and 17, heating coil 9 and drain connection 14.

Figure 4:
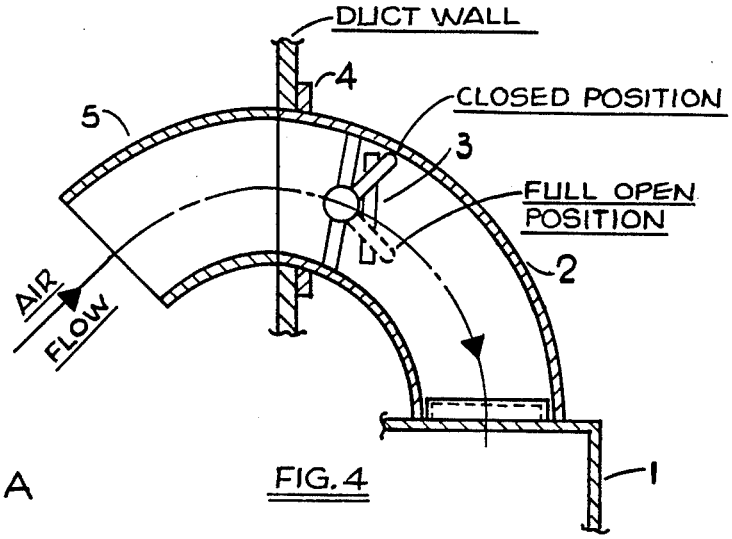
FIG. 4 Is a detail showing the damper, damper positions, and air inlet scoop taken from FIG. 3.

FIG. 4 is an expanded detail of FIG. 3 showing the flow control damper 3 and inlet air scoop 5. The inlet air scoop diverts a portion of the main hot dry air supply into and through the water box 1.

Item 11 (FIG. 5) is a standard all plastic float level water control valve. This valve opens and closes when the water level rises (close) open (falls) thus maintaining a constant water level in the water box 1.

Item 9 (FIG. 5) hot water heating coil. As indicated before, this coil maintains a fairly even temperature of the water used for humidification due to the demand factor of the heating system which is approximately 3 to 4 times an hour.

Figure 5:
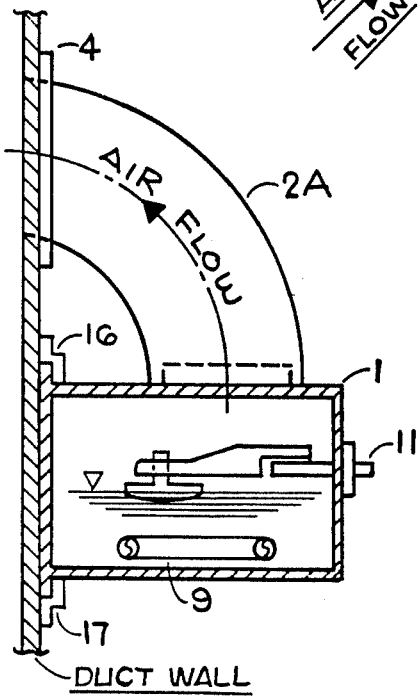
FIG. 5 Is a section taken on line 5—5 in FIG. 1.
Figure 6:
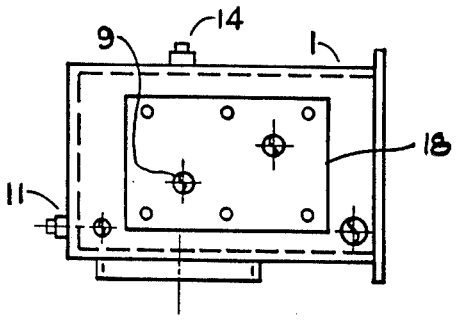
FIG. 6 Is an end view of FIG. 7.
Figure 7:
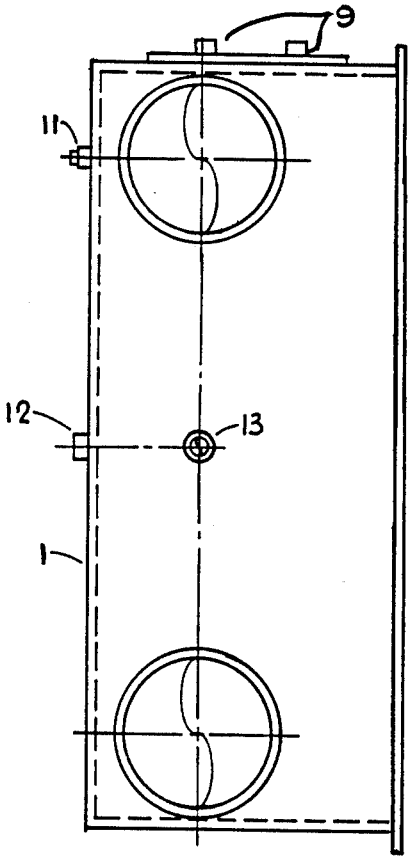
FIG. 7 Is a section taken on line 7—7 in FIG. 1.
Figure 8:
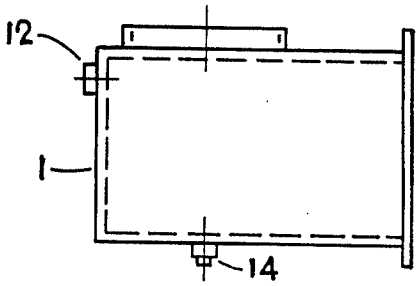
FIG. 8 Is an end view of FIG. 7.

As indicated in FIG. 3 and FIG. 5 the water box has a flanged front. This feature makes mounting very easy due to the box clips into the bottom clip 17 and the top clip 16 can rotate for ease of installation or removal. The elbow mounting plates can be pop riveted or sheet metal screw attached. The installation of the humidifier can be made with standard hand tools and by most homeowners.

Modifications may be made departing from the scope of the invention. For example, the shape and size of the water box (humidifier) could be other than those illustrated and the top of the water box could be made removable to ease removal of the heating coil and it is intended that all such modifications be included within the scope of this invention.

I claim:

1. An air operated humidifying system comprising a water box installed on the hot air duct of a forced air circulation heating system, inlet and outlet means at each end of said box extending into said hot air duct and diverting a portion of the hot air into said water box and back to said hot air duct, a source of hot water communicating with said water box and means to control the flow of said water into said water box so as to maintain a predetermined level of water therein, a hot water heating coil positioned to be immersed in said water in the water box, a hot water tank, and conduit means supplying by gravity flow hot water from the outlet of said tank to said hot water heating coil and back to said tank.

* * * * *